US006380830B1

(12) United States Patent
Dahl et al.

(10) Patent No.: US 6,380,830 B1
(45) Date of Patent: Apr. 30, 2002

(54) LOW-VOLTAGE CIRCUIT-BREAKER WITH A RETROFITTED POWER-DRIVEN LIFT

(75) Inventors: Jörg Uwe Dahl, Werder; Ludvik Godesa, Berlin; Marc Liebetruth, Glienicke, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/743,350

(22) PCT Filed: Jun. 30, 1999

(86) PCT No.: PCT/DE99/02030

§ 371 Date: Jan. 9, 2001

§ 102(e) Date: Jan. 9, 2001

(87) PCT Pub. No.: WO00/03405

PCT Pub. Date: Jan. 20, 2000

(30) Foreign Application Priority Data

Jul. 9, 1998 (DE) ..... 198 32 592

(51) Int. Cl.[7] ..... H01H 3/00
(52) U.S. Cl. ..... 335/68; 335/202; 200/400
(58) Field of Search ..... 335/68–74; 200/400, 200/50.01, 50.15

(56) References Cited

U.S. PATENT DOCUMENTS

| | | | |
|---|---|---|---|
| 4,649,244 | A | 3/1987 | Baginski et al. |
| 4,901,821 | A | 2/1990 | Robbins |
| 5,025,171 | A | 6/1991 | Fanta et al. |

FOREIGN PATENT DOCUMENTS

| | | |
|---|---|---|
| DE | 1908751 | 11/1970 |
| DE | C2-3711138 | 7/1992 |

*Primary Examiner*—Lincoln Donovan

(57) ABSTRACT

A low-voltage circuit breaker includes a retrofittable motor reset mechanism. Its output shaft can be coupled to a charging shaft, mounted in a bearing block, of the spring energy store of the low-voltage circuit breaker. Centering elements are provided on a flange of the bearing block of the charging shaft of the spring energy store so as to engage in mating elements on the gearbox output of the motor reset mechanism, in such a way that the motor reset mechanism can be pushed axially into these centering elements with little movement in the direction of the charging shaft. In order to lock the motor reset mechanism in the pivoting direction, a fixing element is provided at a point fitted at a specific distance from the centering elements. The motor reset mechanism is fixed axially in the centering elements of the flange of the bearing block of the charging shaft of the spring reset mechanism, and in the coupling of the charging shaft.

6 Claims, 5 Drawing Sheets

LOW-VOLTAGE CIRCUIT-BREAKER WITH A RETROFITTED POWER-DRIVEN LIFT

This application is the national phase under 35 U.S.C. § 371 of PCT International Application No. PCT/DE99/02030 which has an International filing date of Jun. 30, 1999, which designated the United States of America.

FIELD OF THE INVENTION

The invention relates to a low-voltage circuit breaker with a retrofittable motor reset mechanism, whose output shaft can be coupled to a charging shaft, mounted in a bearing block, of the spring energy store of the low-voltage circuit breaker.

BACKGROUND OF THE INVENTION

Low-voltage circuit breakers generally have a manual drive as basic equipment, in which a spring energy store is charged with a specific predetermined number of movement strokes. The "charged" state of the spring energy store is then indicated, and the breaker is ready to be switched on if the other interlocking conditions, such as "door closed", "crank of the traction drive withdrawn", and the like are met.

For higher demands on management or convenience, there is then additionally the motor reset mechanism. Because the manual reset mechanism is the basic embodiment and the motor reset mechanism is an additional piece of equipment, the motor reset mechanism is designed in such a way that it forms a retrofittable unit. In this case, it is intended for retrofitting to be possible even in switches which have already been installed in a switching system. This is to be possible without a great deal of effort.

The motor reset mechanism unit generally includes of a housing in which there is a geared motor, whose gearbox has a large reduction ratio and whose output shaft is coupled to the charging shaft of the spring energy store of the low-voltage circuit breaker, on which shaft the manual reset mechanism also acts.

U.S. Pat. No. 4,901,821 shows, in particular in FIG. 3, the fixing of a motor gearbox unit for the reset mechanism of the spring energy store of a low-voltage circuit breaker, in which this motor gearbox unit is fixed to a supporting plate by means of screws. This necessitates access to the screws from one side of the supporting plate, and space to attach the motor gearbox unit from the other side of the same. Subsequent installation of the motor gearbox unit in a low-voltage circuit breaker incorporated in a switching system is not possible in this embodiment.

In addition, a motor gearbox unit, described in U.S. Pat. No. 4,649,244, for resetting an energy store in order to switch off a low-voltage circuit breaker is not suitable for subsequent incorporation from the front in a switch located in a switching system. All the previous embodiments of motor reset mechanisms for charging spring energy stores in low-voltage circuit breakers permits installation only from the side of the low-voltage circuit breaker, that is to say not in switches incorporated in a switching system. The trouble-free retrofitting of such switches in a switching system is therefore not possible.

SUMMARY OF THE INVENTION

Consequently, the object of the present invention is to provide a fixing means for motor reset mechanisms which permits the same to be installed from the front side of the low-voltage circuit breaker, and therefore permits the retrofitting of such switches in a built-in position.

In order to achieve this object, according to the invention, centering elements are provided on a flange of the bearing block of the charging shaft of the spring energy store so as to engage in mating elements on the gearbox output of the motor reset mechanism, into which centering elements of the motor reset mechanism can be pushed axially with little travel in the direction of the charging shaft. The small axial travel or movement needed when the motor reset mechanism is pushed into the centering elements permits the subsequent installation of the motor reset mechanism from the front side in a switch incorporated in a switching system, if retrofitting is desired. The motor reset mechanism can be pivoted in these centering elements and is pushed into these centering elements in a position in the switch in which it is pivoted in the direction of the front side of the switch. At the same time, the coupling between the gearbox output and the charging shaft of the spring reset mechanism is also produced. Furthermore, in order to lock the motor reset mechanism in the pivoting direction, a fixing means is provided at a point fitted at a specific distance from the centering elements. In addition, there are means for fixing the motor reset mechanism axially in the centering elements of the flange of the bearing block of the charging shaft of the spring reset mechanism, and in the coupling of the charging shaft.

Consequently, some features of the conventional motor reset mechanism are maintained, in particular the face toothing on the shafts to be coupled to each other, and the sprung pressing device for the stub axle of the motor reset mechanism. The fixing means for locking the motor reset mechanism in the pivoting direction can advantageously comprise a latching element on the motor/gearbox block of the motor reset mechanism, and a spring latch means arranged in the insulating parts on the breaker frame. However, it can also be formed by an eye on the motor/gearbox block of the motor reset mechanism, a threaded hole in a stop and a screw which can be screwed into the threaded hole through the eye. The significant factor in every case is manipulation in the installation direction of the motor reset mechanism, that is to say from the front side of the low-voltage circuit breaker.

The means for fixing the motor reset mechanism axially in the centering elements of the flange of the bearing block of the charging shaft of the spring reset mechanism, and in the coupling of the charging shaft, is advantageously a rigid supporting arm which is fitted to the bearing block of the charging shaft of the spring reset mechanism and has an integrally molded angle.

In an alternative embodiment, the means for fixing the motor reset mechanism axially in the centering elements of the flange of the bearing block of the charging shaft of the spring reset mechanism, and in the coupling of the charging shaft, can also be a springy wire loop which is fixed by hooks in holes in the bearing block of the charging shaft of the spring energy store and which encloses the motor reset mechanism and can be locked in latching elements provided for the purpose on the motor reset mechanism. Before the motor reset mechanism is incorporated, this wire loop is mounted by means of the holes. The hook-like ends of the wire loop and the holes are dimensioned such that the wire loop can hang downward and does not impede the insertion of the motor reset mechanism. It is additionally dimensioned such that it encloses the motor reset mechanism. The final position of the motor reset mechanism is defined by suitable stops and, in this end position, the wire loop can be pulled up from below over the motor reset mechanism and locked in latching elements provided for the purpose.

A wire loop of this type for fixing a structural element, here an extinguishing chamber for an item of electrical switchgear, by means of a springy wire clip, is described in DE-A 1 908 751 for example. An identical fixing means for fixing distributor caps in ignition distributors of motor vehicles is generally known. However, in all the known cases, they are used only for fixing passive elements, which are not subjected to any significant mechanical stresses. The advantage of the wire loop in the present application resides in the fact that it does not in principle have to be incorporated, like the rigid supporting arm, regardless of whether it is needed at all or not. It is also cheaper and can be supplied together with the motor reset mechanism. Of course, a combination of the two fixing means can also be used.

BRIEF DESCRIPTION OF THE DRAWINGS

The invention will be explained in more detail below using preferred exemplary embodiments illustrated in the figures.

DETAILED DESCRIPTION OF PREFERRED EMBODIMENTS

Figure 1:
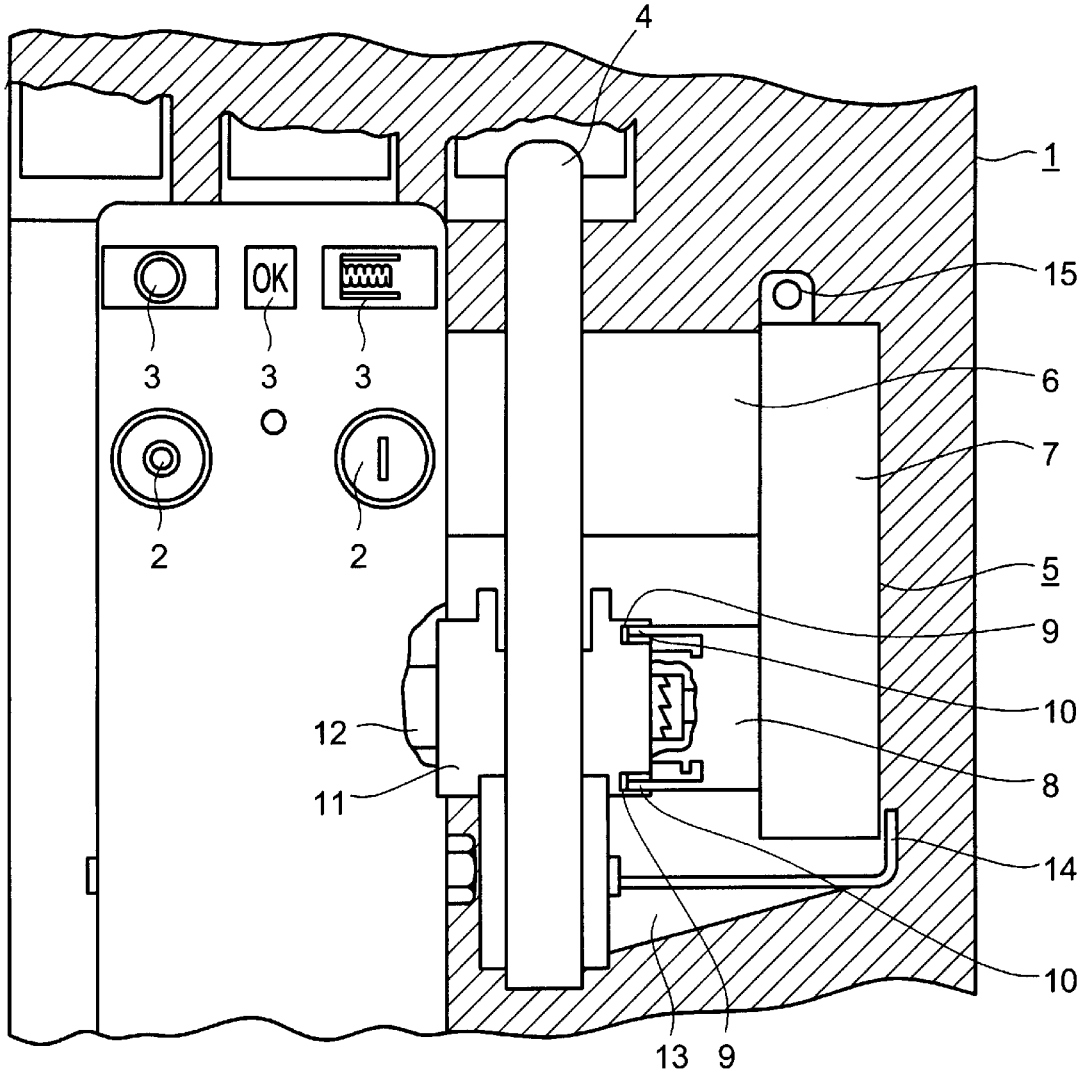
FIG. 1 shows, schematically, the arrangement of the motor reset mechanism for the spring energy store in the view from the front side of the low-voltage circuit breaker.

In order to illustrate the physical relationships, FIG. 1 shows, schematically, the arrangement of the motor reset mechanism for the spring energy store in the view from the front side of the low-voltage circuit breaker 1, with the known operating elements 2, such as ON and OFF pushbuttons, the indicating elements 3, such as standby indicator and store indicator. Shown behind the manual reset lever 4 is the motor reset mechanism 5, including the motor 6, the gearbox 7 and the coupling 8, in the fixed position. Provided on a flange of the bearing block 11 of the charging shaft 12 of the spring energy store are centering elements 9 to engage in mating elements 10 on the gearbox output of the motor reset mechanism 5 which, in addition to their centering function, form a fixing point of the motor reset mechanism 5. By means of a supporting arm 13 which is fixed to the bearing block 11 of the charging shaft 12 of the spring energy store and is provided with an integrally molded angle 14, the motor reset mechanism 5 is locked in the axial direction in the coupling 8 and the centering elements 9 of the latter.

Figure 6:
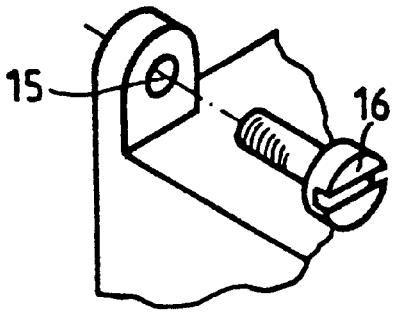
FIG. 6 shows a further possible form of the fixing of the motor reset mechanism in the pivoting direction.

This supporting arm 13 at the same time forms the support for the motor reset mechanism 5. For the purpose of locking in the pivoting direction about the axis of the coupling 8, in this embodiment an eye 15 is provided, by means of which the motor reset mechanism 5 can be fixed by a screw 16 (FIG. 6) to a suitable stop 17 provided with an appropriate threaded hole (FIGS. 2 and 3).

Figure 2:
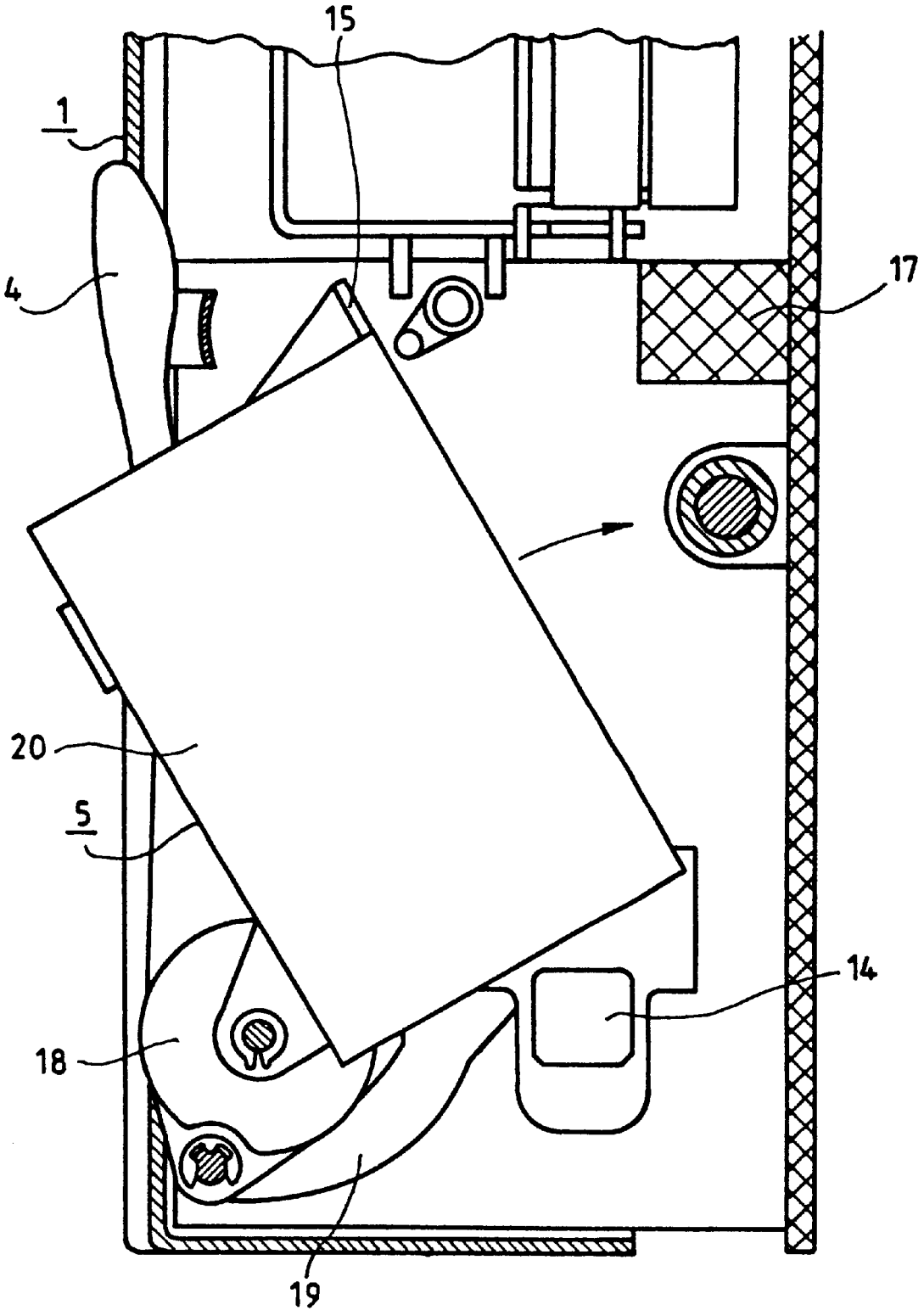
FIG. 2 shows, schematically, a lateral section, through a low-voltage circuit breaker with the motor reset mechanism in the position in which it is inserted.

FIG. 2 shows a lateral section through a low-voltage circuit breaker 1 with the hand reset lever 4 as basic equipment, which charges the spring energy store step by step during each stroke by means of a crank rocker 18 via a ratchet 19, as well as the motor reset mechanism 5 according to the invention in the position pivoted toward the front side of the breaker, in which position it is inserted. As viewed from a position standing in front of the breaker, it is installed from the front with a slight lateral travel, since this is the most beneficial method of installation for coupling to the charging shaft 12 of the spring energy store. The motor reset mechanism 5 is inserted in the pivoted position illustrated, it being possible for it to be led past the angle 14 of the supporting arm 13, then tilted rearward in the breaker in the direction of the arrow and latched in. The parts of the toothed coupling are centered by means of centering elements 9 which are located on the bearing block 11 of the charging shaft 12 of the spring energy store and on the gearbox output-of the motor reset mechanism 5.

Figure 3:
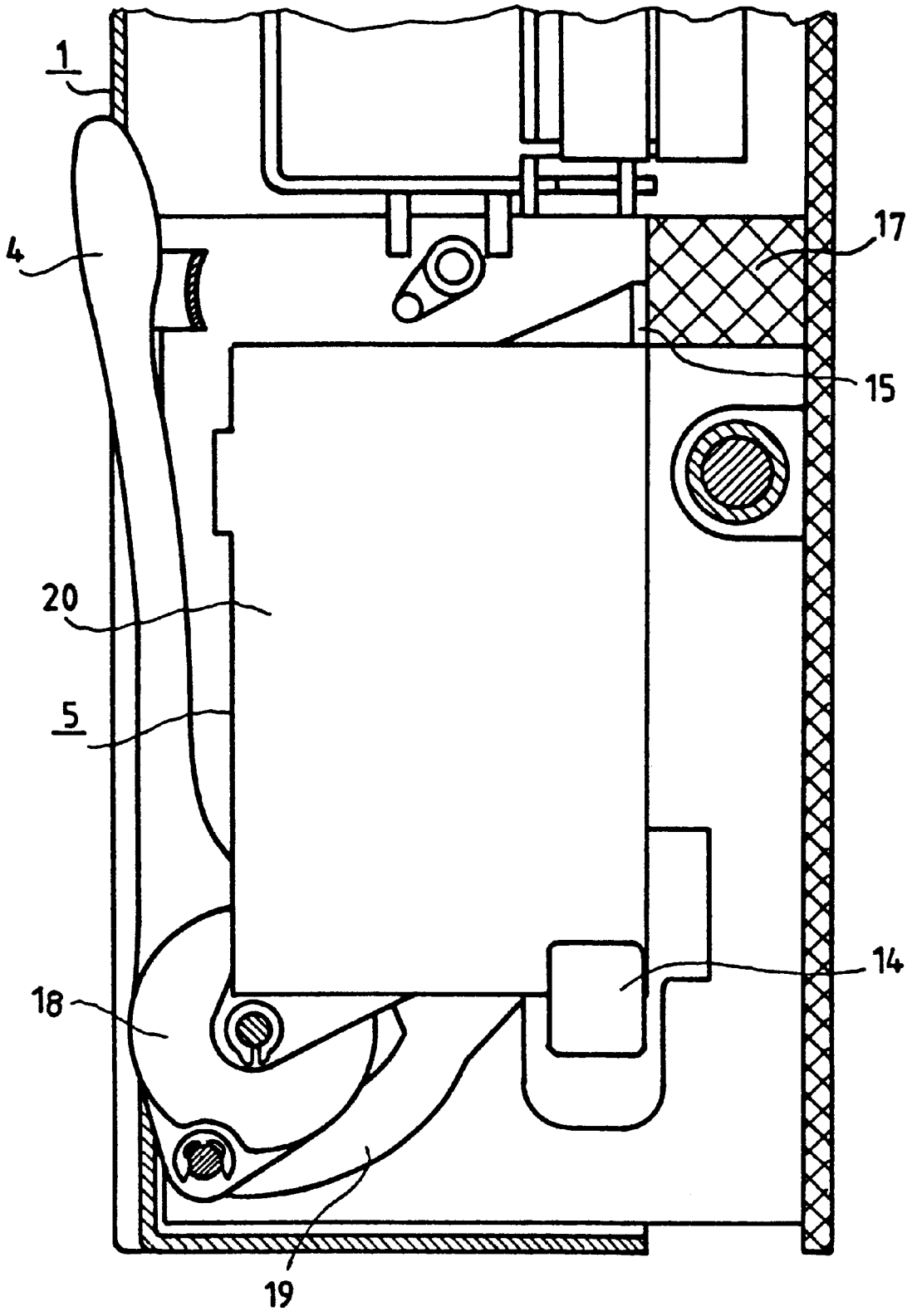
FIG. 3 shows, schematically, a lateral section through a low-voltage circuit breaker with the motor reset mechanism in the fixed position.

FIG. 3 shows the motor reset mechanism 5 in the locked position. In this position, it is engaged with the angle 14 of the supporting arm 13 and is therefore fixed in the axial direction The radial fixing of the motor reset mechanism 5 is carried out by means of the centering elements 9, which are in engagement, on the bearing block 11 of the charging shaft 12 of the spring energy store and on the gearbox output of the motor reset mechanism 5. In order to lock it in the pivoting direction about the axis of the coupling 8, the motor reset mechanism 5 in this embodiment is provided with an eye 15, by means of which it can be fixed, by a screw 16 (FIG. 6), to a stop 17 provided with an appropriate threaded hole (not illustrated).

Figure 4:
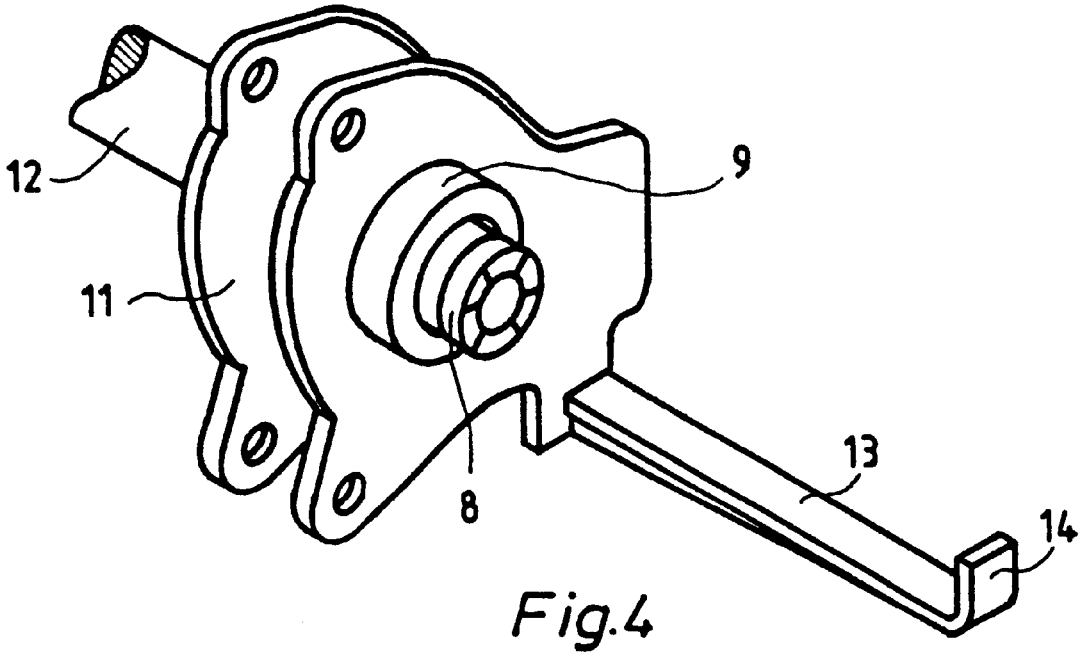
FIG. 4 shows the bearing block of the charging shaft of the spring energy store, on which the motor reset mechanism is mounted.

FIG. 4 shows the bearing block 11 of the charging shaft 12 of the spring energy store, on which the motor reset mechanism 5 is mounted so as to be centered. The motor reset mechanism 5 is pushed into the coupling 8 of the charging shaft 12 in the position shown in FIG. 2, both the centering elements 9 on the bearing block 11 and the coupling elements of the coupling 8 coming into engagement with corresponding mating elements 10 on the gearbox output of the motor reset mechanism 5 and then being pivoted until it strikes the stop 17 and is seated on the supporting arm 13, which then belongs to the basic equipment of the low-voltage circuit breaker 1, and is then fixed in the axial direction in the coupled-in position by the angle 14 of the supporting arm 13.

Figure 5:
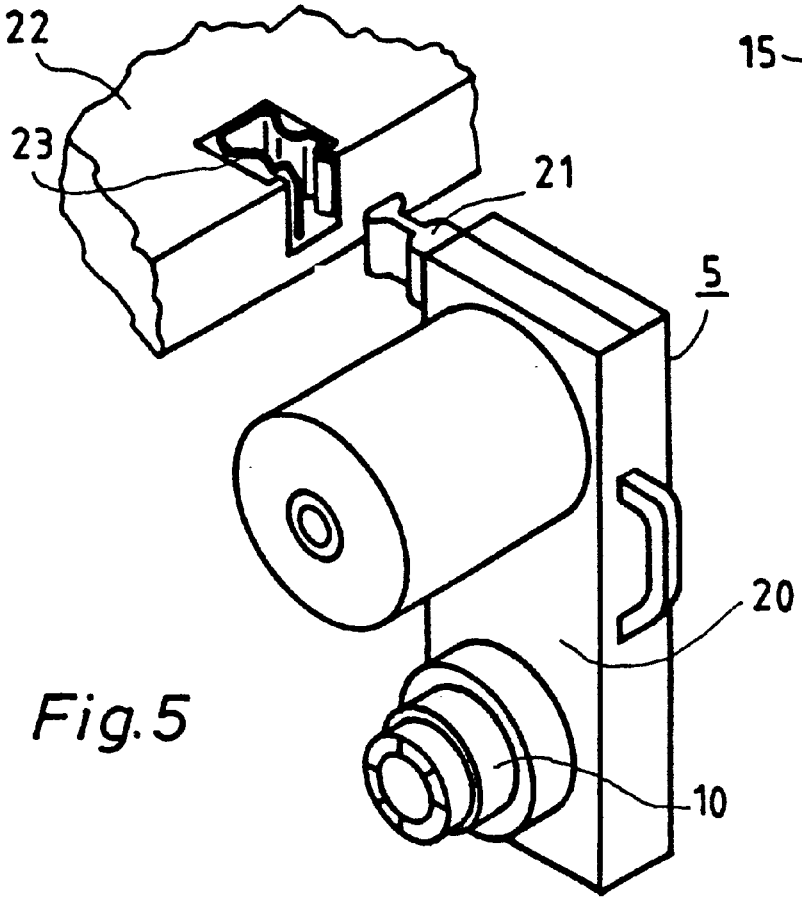
FIG. 5 shows a possible form of the fixing of the motor reset mechanism in the pivoting direction.

FIG. 5 shows another possible form of the fixing of the motor reset mechanism 5 in the pivoting direction. Provided on the motor/gearbox block 20 is a latching element 21, which is pressed into a spring latch means 23 provided in the insulating parts 22 on the breaker frame, and is therefore secured against pivoting back.

FIG. 6 shows once again, in detail, the possible form, mentioned in connection with FIG. 3, of the fixing of the motor reset mechanism 5 in the pivoting direction. Here, on the motor/gearbox block 20 there is provided an eye 15, by means of which the block is secured against pivoting back with the aid of a screw 16 on a corresponding stop (not illustrated here) on the breaker frame.

Figure 7:
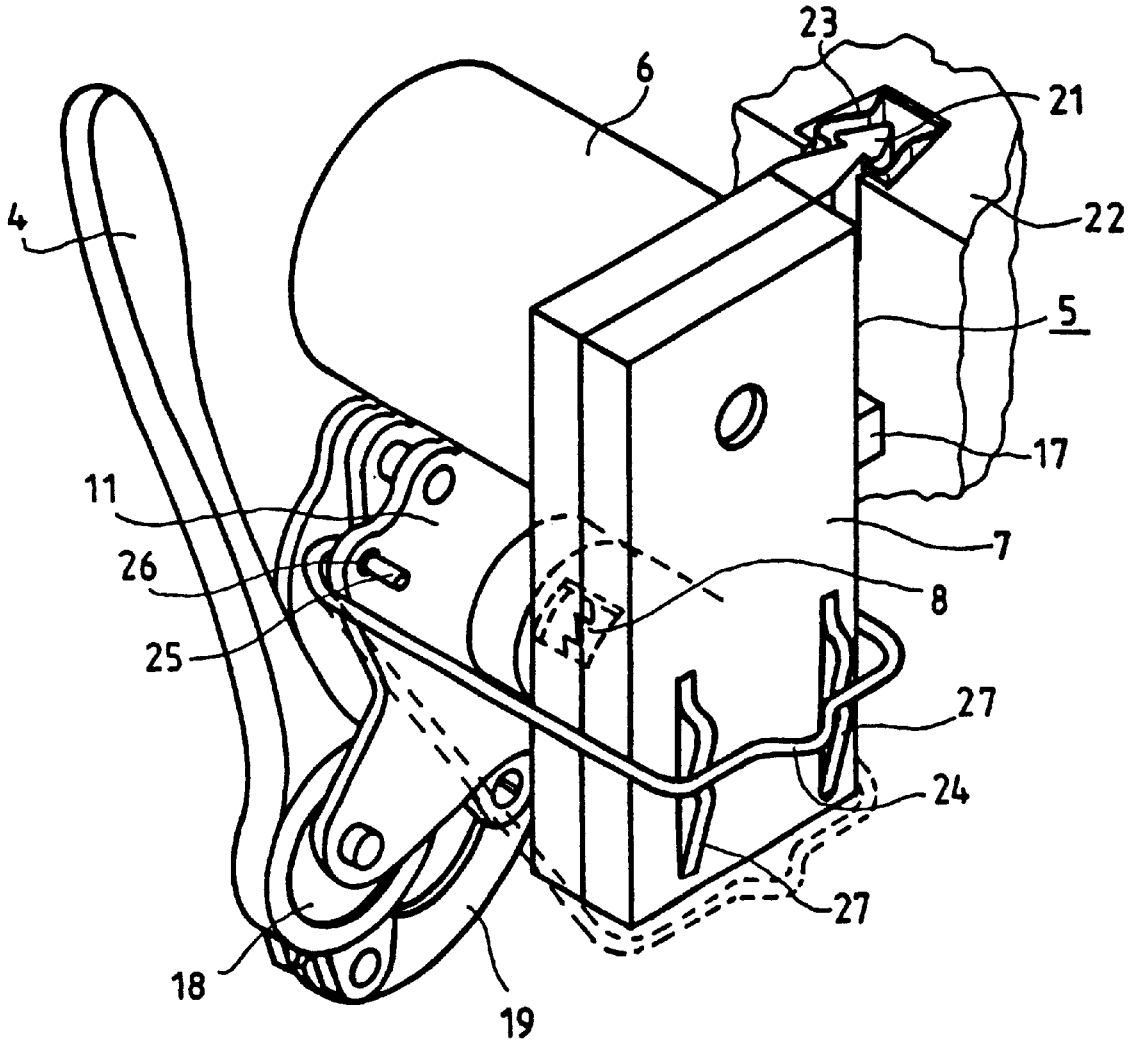
FIG. 7 shows an alternative form of the fixing of the motor reset mechanism.

FIG. 7 shows an alternative fixing of the motor reset mechanism 5 by means of a latching spring loop. A springy wire loop 24, which hangs downward in the unused state as a result of the hinge action of its fixing by means of hooks 25 in holes 26 in the bearing block 11 of the charging shaft 12 of the spring energy store, as indicated by the dashed representation, is pushed over latching elements 27 arranged on the motor/gearbox block 20, after the motor reset mechanism 5 has been inserted. It locks the motor reset mechanism 5, in the same way as the angle 14 of the supporting arm 13, in the bearing block 11 of the charging shaft 12 of the spring energy store. In order to release it, the springy wire loop 24 is pressed downward, and the motor reset mechanism 5 can be removed again. In order to fix it in the pivoting direction about the axis of the coupling 8, the motor/gearbox block 20 of the motor reset mechanism 5 is provided in this embodiment with a latching element 21, which presses into a spring latching means 23 provided in the insulating parts 22 on the breaker frame, and therefore secures the motor reset mechanism 5 against pivoting back.

The fixing according to the invention for motor reset mechanisms of low-voltage circuit breakers permits the motor reset mechanism to be installed from the front side of the low-voltage circuit breaker, and therefore permits the retrofitting of such breakers in an incorporated position. At the same time, as a further advantage, some features of the conventional motor reset mechanism are maintained, in particular the face toothing of the shafts to be coupled to each other, and the sprung pressing device for the stub axle of the motor reset mechanism.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A low-voltage circuit breaker with a retrofittable motor reset mechanism, whose output shaft is coupled to a charging shaft, mounted in a bearing block, of a spring energy store of the low-voltage circuit breaker, comprising:

centering elements provided on a flange of the bearing block of the charging shaft of the spring energy store, engaged with mating elements on the gearbox output of the motor reset mechanism such that the motor reset mechanism is pushed axially into the centering elements in a direction of the charging shaft, and such that the motor reset mechanism is installed with little lateral movement;

fixing means, pivotably mounted with the centering elements, in order to lock the motor reset mechanism in a pivoting direction, the fixing means being provided at a point fitted at a specific distance from the centering elements; and means for fixing the motor reset mechanism axially in the centering elements of the flange of the bearing block of the charging shaft of the spring reset mechanism, and in the coupling of the charging shaft.

2. The low-voltage circuit breaker as claimed in claim 1, wherein the fixing means for locking the motor reset mechanism in the pivoting direction comprises a latching element on a block of the motor reset mechanism, and a spring latch arranged in an insulating part on the breaker frame.

3. The low-voltage circuit breaker as claimed in claim 1, wherein the fixing means for locking the motor reset mechanism in the pivoting direction comprises an eye on the block of the motor reset mechanism, a threaded hole in a stop and a screw which can be screwed into the threaded hole through the eye.

4. The low-voltage circuit breaker as claimed in claim 1, wherein the means for fixing the motor reset mechanism axially in the centering elements of the flange of the bearing block of the charging shaft of the spring reset mechanism, and in the coupling of the charging shaft, includes a rigid supporting arm which is fitted to the bearing block of the charging shaft of the spring reset mechanism and has an integrally molded angle.

5. The low-voltage circuit breaker as claimed in claim 1, wherein the means for fixing the motor reset mechanism axially in the centering elements of the flange of the bearing block of the charging shaft of the spring reset mechanism, and in the coupling of the charging shaft, includes a springy wire loop which is fixed by hooks in holes in the bearing block of the charging shaft of the spring energy store and which encloses the motor reset mechanism and can be locked in latching elements on the motor reset mechanism.

6. The low-voltage circuit breaker as claimed in claim 1, wherein the means for fixing the motor reset mechanism is a rigid support arm which is fitted to the bearing block and which has an angled portion at a free end thereof.

* * * * *